United States Patent [19]

Hori

[11] Patent Number: 4,674,732

[45] Date of Patent: Jun. 23, 1987

[54] PAPER BINDING MACHINE

[75] Inventor: Katsumi Hori, Tokyo, Japan

[73] Assignee: Plus Corporation, Tokyo, Japan

[21] Appl. No.: 820,086

[22] Filed: Jan. 21, 1986

[30] Foreign Application Priority Data

Feb. 7, 1985 [JP] Japan ..... 60-16419[U]

[51] Int. Cl.[4] ..... B42B 1/02; B65H 31/36

[52] U.S. Cl. ..... 270/53; 227/6; 227/154; 271/221

[58] Field of Search ..... 270/53, 37; 227/2, 5–7, 227/140, 154, 19, 39, 103, 120, 144, 154, 127–129; 271/221

[56] References Cited

U.S. PATENT DOCUMENTS

| | | | |
|---|---|---|---|
| 3,250,529 | 5/1966 | Eissfeldt et al. | 271/221 |
| 3,862,752 | 1/1975 | Totten | 271/221 X |
| 4,182,474 | 1/1980 | Sato | 227/99 |
| 4,371,155 | 2/1983 | Astero et al. | 270/53 |
| 4,497,478 | 2/1985 | Reschenhofer et al. | 270/53 |
| 4,515,356 | 5/1985 | Mullritter et al. | 270/53 |
| 4,566,782 | 1/1986 | Britt et al. | 270/53 |
| 4,595,187 | 6/1986 | Bober | 270/37 |

*Primary Examiner*—E. H. Eickholt

*Attorney, Agent, or Firm*—McAulay, Fields, Fisher, Goldstein & Nissen

[57] ABSTRACT

A paper binding machine is disclosed. A paper receiving frame having a channel-shaped section is secured to a base in an inclined manner. A paper binder is provided at the lower end of the paper receiving frame, while a guide frame is provided at the upper end of the paper receiving frame in such a manner that the lower end of the guide frame is disposed directly on the receiving frame. The guide frame inclined at substantially the same angle as the paper receiving frame is connected to a vibrating device, and a stopper for releasing the lower end of the opening of the paper receiving frame after binding has been completed such as to be capable of being freely opened and closed.

5 Claims, 4 Drawing Figures

PAPER BINDING MACHINE

BACKGROUND OF THE INVENTION

1. Field of the Invention

The present invention relates to a paper binding machine for automatically jogging a plurality of sheets of paper and binding them together.

2. Description of the Prior Art

Conventionally, when binding a plurality of sheets of paper, they are manually jogged in advance, and the jogged paper is placed at a given position on the paper binding machine where staples are driven into the paper. In this way, when binding the paper with staples, it is necessary to manually jog it, which is a considerably troublesome task.

SUMMARY OF THE INVENTION

Accordingly, it is an object of the present invention to provide a paper binding machine which is capable of automatically jogging a plurality of sheets of paper and binding them together.

To achieve this aim, a paper binding machine according to the present invention comprises a vibrating device for jogging the paper placed on a guide frame while vibrating the guide frame, a receiving frame disposed below the guide frame for receiving the jogged paper fed from the guide frame, a paper binder provided at the lower end of the receiving frame, and a stopper which is provided at the lower end of the opening of the receiving frame and which is engaged with the receiving frame when receiving the paper from the guide frame and is released therefrom when discharging the bound paper to the outside.

The above and other objects, features and advantages of the present invention will become clear from the following description of the preferred embodiments thereof, taken in conjunction with the accompanying drawings.

BRIEF DESCRIPTION OF THE DRAWINGS

The drawings show in combination an embodiment of a paper binding machine according to the present invention, wherein.

DESCRIPTION OF THE PREFERRED EMBODIMENT

Figure 1:
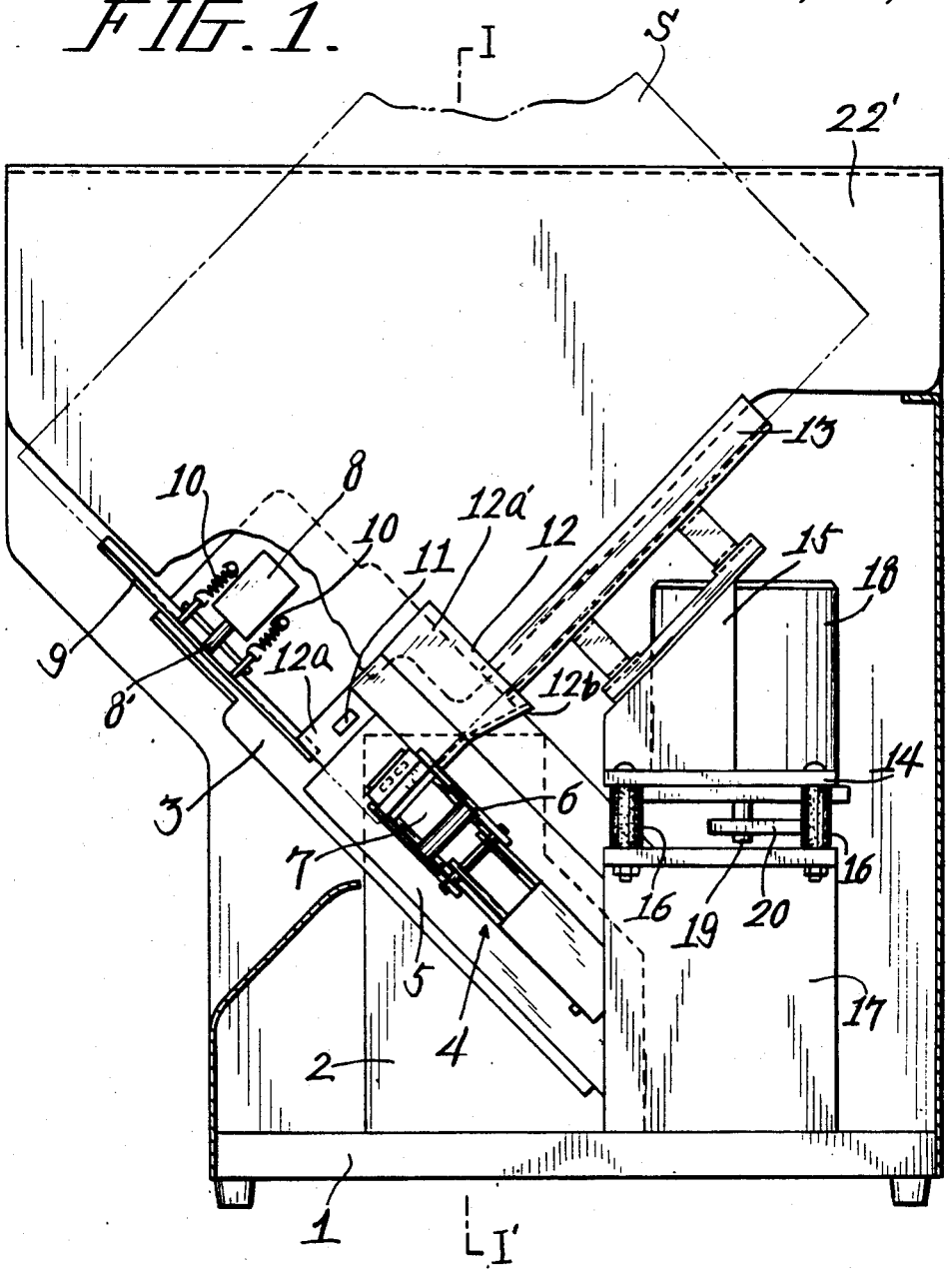
FIG. 1 is a partially cutaway sectional view.
Figure 2:
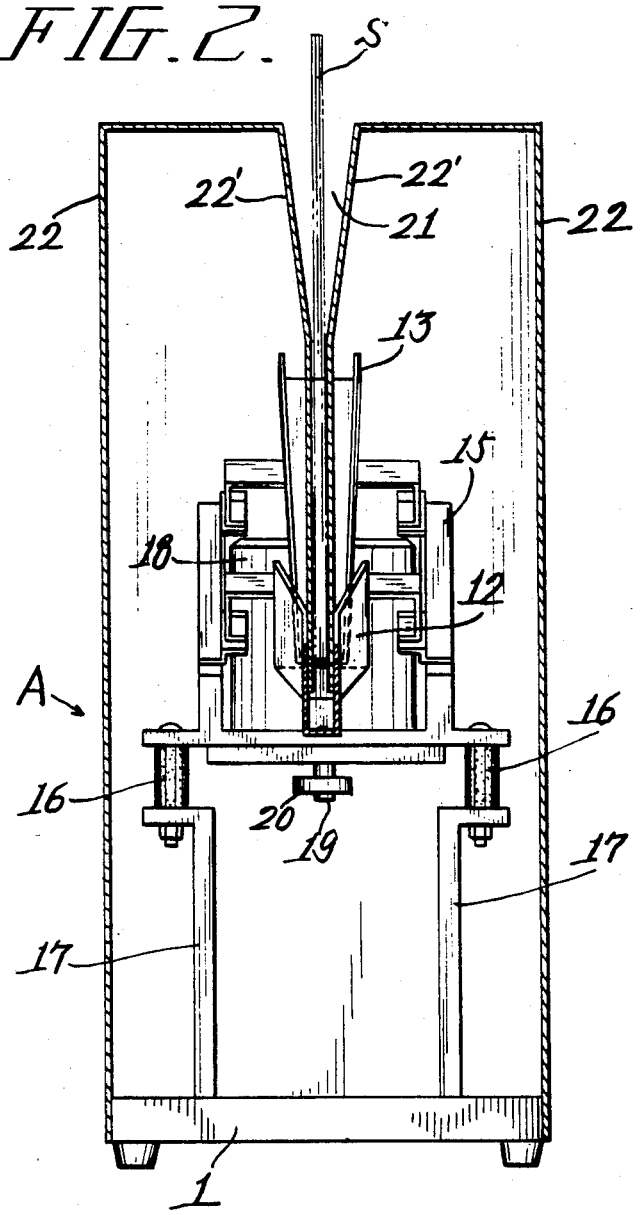
FIG. 2 is a sectional view of the embodiment shown in FIG. 1, taken along the line I—I'.
Figure 3:
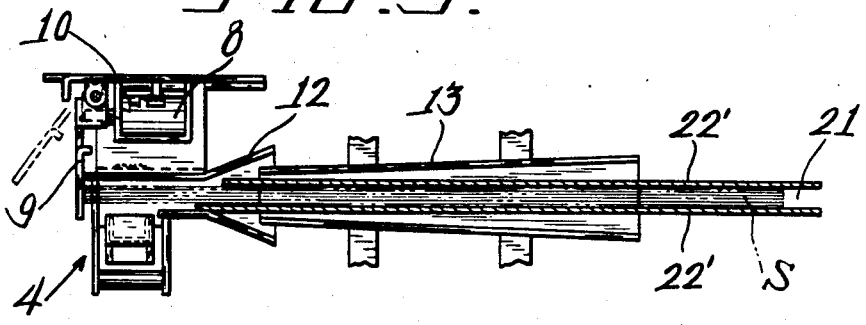
FIG. 3 is a partially cutaway sectional view.
Figure 4:
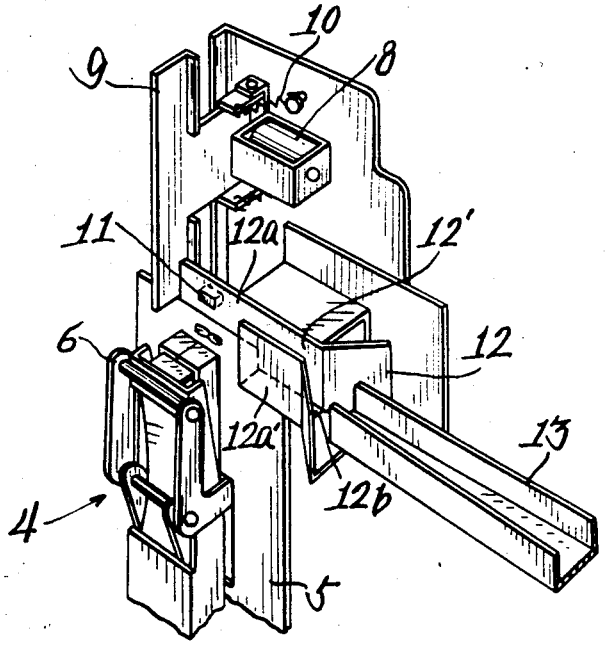
FIG. 4 is a perspective view of a part of the embodiment.

An embodiment of a paper binding machine according to the present invention will be explained hereinunder with reference to the accompanying drawings. The reference numeral 1 denotes a base, 2 an adapter base plate erected on the base 1, 3 an adapter plate secured to the base plate 2 in an inclined manner, and 4 a paper binder provided at the lower portion of the adapter plate 3 in an inclined manner. The paper binder 4 is composed of an operating frame 6 with a staple pushing plate (not shown) provided at the end thereof, and a staple containing frame 7 disposed between a staple receiving plate 5 and the operating frame 6 in such a manner that it may freely move into and out of the upper end of the operating frame 6. The paper binder 4 is rotatably attached to the middle portion of a staple receiver plate 5 which is secured to the adapter plate 3.

The reference numeral 8 is an electromagnet attached at the upper end of the adapter plate 3 where it forms an extension of the paper binder 4. A stopper for paper S is disposed at the end of the iron core 8' of the electromagnet 8, and is pivotably hinged to the adapter plate 3. A return spring 10 provided between the stopper 9 and the adapter plate 3 positions the stopper in alignment with the direction in which the paper S is received. A detector 11 provided between the electromagnet 8 and the paper binder 4 is secured to a side piece **12*a* of a receiving frame 12 which is secured to the adapter plate 3**.

The receiving frame 12 is composed of an opposing pair of side pieces **12*a*, 12*a'*, and a bottom piece 12*b*. Each of the pieces 12*a*, 12*a'*, and 12*b* is opened at the end which is remote from the paper binder 4 such that they form in combination a widened entrance of a channel-shaped frame. The receiving frame 12 is inclined at the upper end of the paper binder 4 in the direction perpendicular thereto in such a manner that a space portion 12' between the side pieces 12*a*, 12*a'* conforms with the space between the staple receiving plate 5 and the operating frame 6**.

A guide frame 13 is so designed as to have a channel-shaped section. The lower end of the receiving frame 12 is erected directly on the opened portion of the receiving frame 12 in an inclined manner along the line which forms an extension of the receiving frame 12 and is secured to a vibrating table 14 through a support frame 15 erected on the vibrating table 14. The vibrating table 14 is mounted through rubber supports 16 on an underframe 17 which is erected on the base 1. A motor 18 is mounted on the vibrating table 14 with the shaft 19 pierced through the vibrating table 14 and projecting into the underside of the vibrating table 14. A weight 20 is secured to the middle portion of the projecting shaft 19 such as to project into one side of the vibrating table 14.

The reference numeral 21 denotes a hopper constituted by member pieces 22' of a cover frame 22. The lower ends of the member pieces 22 are inserted into the guide frame 13 so that the paper S thrown into the hopper 21 may be introduced to and received by the guide frame 13.

The operation of the paper binding machine A will now be explained.

When the motor 18 is actuated, the shaft 19 of the motor 8 which is provided with the weight 20 rotates eccentrically. This rotation vibrates the vibrating table 14 supported by the rubber supports 16, and the vibration of the vibrating table 14 in turn vibrates the guide frame 13 through the support frame 15.

When a plurality of sheets of paper S which have been jogged to a certain degree is thrown from the hopper 21, the paper S is received by the vibrating guide frame 13 and the stopper 9 and jogged while being vibrated. When the paper S thrown reaches the stopper 9 situated at the lower end of the receiving frame 13, the detector 11 detects it and supplies a signal to a control device (not shown). After a predetermined period has passed since the control device has received the signal, it supplies a signal to the paper binder 4. The paper binder binds 4 the paper S when it receives this signal.

During the binding operation, the paper S is subjected to the vibration of the guide frame 13.

At the completion of the binding operation, a signal is supplied from the control device to the electromagnet 8, which is excited at the reception of the signal. The iron core 8' presses the stopper 9 in resistance to the return spring 10, so that the bound paper S which is held by the stopper 9 is released from the receiving frame 12 to the outside. When the paper S is discharged, the detector 11 detects it, and supplies a signal to the control device. When the control device receives the signal, it stops supplying a signal to the electromagnet 8, namely, the excitation of the electromagnet is stopped, whereby the stopper 9 returns by virtue of the return spring 10 and each element is restored to its original state.

The rubber spring 16 may be replaced by any other suitable means having flexibility, e.g., a spring.

Although the guide frame 13 is inclined by 45 degrees in this embodiment, the angle employed may be selected as desired. The motor 18 which causes vibration in this embodiment is disposed in such a manner that the shaft is perpendicular to the plane in which the motor is mounted but the angle (or direction) at which the shaft is disposed may be selected appropriately, for example such that the shaft of the motor 18 may be made parallel to the guide frame 13. What is important is that the guide frame 13 is subjected to vibration which enables the paper S to be jogged. It is also possible to vibrate the guide frame by an electromagnet, a cam or the like.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A paper binding machine comprising:

a base;

a paper receiving frame having a channel-shaped cross section with a movable stopper at one end which is secured to said base in an inclined manner;

a paper binder provided at the lower end of said paper receiving frame;

a guide frame provided at the upper end of said paper receiving frame such that the lower end of said guide frame is placed directly on said receiving frame; and a vibrating device connected to said paper receiving frame which is inclined at approximately the same angle as said guide frame;

said stopper being so provided as to be capable of being freely opened and closed to permit binding paper removal.

2. A paper binding machine according to claim 1, including an underframe mounted on said base, said vibrating device comprising a vibrating table which is mounted through rubber supports on said underframe, a motor having a shaft provided with a weight, and a support frame for supporting said guide frame, said motor and said support frame being placed on said vibrating table.

3. A paper binding machine according to claim 1, wherein said paper binder is composed of a staple receiving plate, an operating frame.rotatably supported by said staple receiving plate at the middle position thereof and provided with a staple pushing plate at the end thereof, said operating frame having an upper end and a staple containing frame disposed between said operating frame and said staple receiving plate such that said staple containing frame may freely move into and out of the upper end of said operating frame.

4. A paper binding machine according to claim 1, further comprising a electromagnet, wherein said stopper is opened and closed by said electromagnetic.

5. A paper binding machine according to claim 1, wherein said paper receiving frame is provided with a paper detector which is connected to said paper binder and a device for opening and closing said stopper in response to paper detection by said detector.

* * * * *